US005881343A

United States Patent [19]

Momotani et al.

[11] Patent Number: 5,881,343

[45] Date of Patent: Mar. 9, 1999

[54] CHARGING METHOD AND CHARGING DEVICE

[75] Inventors: Keiko Momotani, Suita; Isao Doi, Toyonaka; Akihito Ikegawa, Sakai, all of Japan

[73] Assignee: Minolta Co., Ltd., Osaka, Japan

[21] Appl. No.: 889,817

[22] Filed: Jul. 8, 1997

[30] Foreign Application Priority Data

Jul. 9, 1996 [JP] Japan ..... 8-179197
Jul. 9, 1996 [JP] Japan ..... 8-179219

[51] Int. Cl.[6] ..... G03G 15/02

[52] U.S. Cl. ..... 399/174; 399/176; 430/702; 361/225

[58] Field of Search ..... 399/174, 175, 399/176; 430/902; 361/225, 229, 230, 235

[56] References Cited

U.S. PATENT DOCUMENTS 5,504,561 4/1996 Ikegawa et al. ..... 399/174

FOREIGN PATENT DOCUMENTS 64-35459 2/1989 Japan .
4-289879 10/1992 Japan .
5-232780 9/1993 Japan .
6-51614 2/1994 Japan .
6-230649 8/1994 Japan .
8-123142 5/1996 Japan .

*Primary Examiner*—Joan H. Pendegrass
*Attorney, Agent, or Firm*—McDermott, Will & Emery

[57] ABSTRACT

A contact charging device, in which a contact member for charging has a surface including a contact portion to be in contact with a charge receiving member as well as a charge contributing portion having a surface resistivity (ρs) of $1\times10^5$ Ω/□ or less. A maximum distance between the contributing portion and the charge receiving member is in a range from 5 μm to 60 μm. Alternatively, an electric power formed of a DC component is applied to the contact member to produce a potential difference in a range from 550 v to 750 v between the applied power and a potential at the surface of the charge receiving member before being charged by the electric power.

29 Claims, 8 Drawing Sheets

CHARGING METHOD AND CHARGING DEVICE

BACKGROUND OF THE INVENTION

1. Field of the Invention

The present invention relates to a charging method and a charging device for charging a charge receiving member. In particular, the invention relates to a charging method and a charging device for charging a charge receiving member through a portion in contact with the charge receiving member. More specifically, the invention relates to a charging method and a charging device having a member to be in contact with an electrostatic latent image carrier such as a photosensitive member in an image forming apparatus for charging the electrostatic latent image carrier to a predetermined potential.

2. Description of the Related Art

In electrophotographic image forming apparatuses such as a copying machine and a printer, a charging device charges an electrostatic latent image carrier such as a photosensitive drum, image exposure is effected on a charged area to form an electrostatic latent image, the electrostatic latent image is developed into a visible image, and this visible image is transferred and fixed onto a transfer member. A charging device is employed for charging the surface of the electrostatic latent image carrier prior to formation of the latent image. The apparatus also employs other charging devices such as a transfer charger for transferring the visible image formed on the electrostatic latent image carrier onto a transfer member and a separating charger for separating the transfer member bearing the transferred visible image from the electrostatic latent image carrier.

As the charging devices, corona charging devices such as a Corotron charging device or a Scorotron charging device utilizing corona discharging have been used. Although the corona charging device can advantageously perform stable charging, it requires a high voltage and produces a large amount of ozone. In recent years, therefore, contact charging devices which can replace the corona charging devices have been proposed.

The contact charging device has a charging member which is subjected to a voltage and is brought into contact with a charge receiving member. The charge receiving member is charged by discharge occurring at a gap between a region, which is continuous to a contact region of the charging member with the charge receiving member and is spaced from the charge receiving member, and the surface of the charge receiving member.

The charging member may take various forms such as a charging roller and a charging brush, and other forms such as a charging blade and a charging film have been proposed.

These contact charging devices have such an advantage that they produce a particularly smaller amount of ozone than the corona charging device. Also, the contact charging device can operate with a voltage lower than that required by the corona charging device.

However, the contact charging device may suffer from the following problem. If the charging member is made of a material of a low resistance such as metal, the surface of the charge receiving member is irregularly charged into a scale-like form (scaly form). Therefore, if the charge receiving member is an electrostatic latent image carrier and a mesh image of 1-dot/4-dots is formed as shown in FIG. 4, irregularity in image density occurs in the mesh image due to lack and/or drop of dots forming mesh points. This results in scale-like noises as shown in FIG. 9. This means that the surface of the charge receiving member was not uniformly charged, and charging irregularity occurred in a scale-like form. This problem does not occur if the charging member is made of a material of a high resistance. Therefore, it has been impossible to employ the charging member of a low resistance such as metal, and it has been required to employ the charging member made of a material of a high resistance such as rubber or resin containing an electrically conductive material dispersed therein.

Charging irregularity in a striped form may occur at the surface of the charge receiving member when a scratch is formed at a portion of the charging member in contact with the charge receiving member and the scratch is stuffed with a foreign material such as toner. For suppressing this, the charging member may be made of a hard material. Such a hard material may be metal. However, metal cannot be employed due to the aforementioned reason. Therefore, it is necessary to employ a charging member made of a material which is formed of specific hard resin and a conductive material such as electrically conductive carbon dispersed therein. The same is true with respect to the case where a charging member having a sufficient resistance against wear is employed.

For the reasons described above, a material of the charging member can be selected only from a limited range.

SUMMARY OF THE INVENTION

An object of the invention is to provide a contact charging method and a contact charging device, in which a material of a contact member to be in contact with a charge receiving member for charging can be selected from a wide range, and charging irregularity in a scale-like form can be suppressed to a practically acceptable extent.

For achieving the above object, the invention provides a method for charging a charge receiving member including the steps of:

providing a conductive member which has a surface including a contact portion and a contributing portion, said contributing portion having a surface resistivity (ρs) of $1\times10^5$ Ω/□ or less;

contacting said contact portion of said conductive member with the charge receiving member, and facing said contributing portion of said member to the charge receiving member so that the maximum distance between said contributing portion and the charge receiving member is in a range from 5 μm to 60 μm; and applying an electrical power consisting of a direct current component to said conductive member to charge said charge receiving member through said contributing portion.

The invention also provides a charging device for charging a charge receiving member comprising:

an electrical power source for supplying an electrical power consisting of a direct current component; and a contact member which is electrically connected with said electrical power source, said contact member having a surface including a contact portion and a contributing portion, said contact portion being for contacting with the charge receiving member, said contributing portion being for facing to the charge receiving member and being in a vicinity of said contact portion, said contributing portion contributing to charge the charge receiving member;

wherein said contributing portion has a surface resistivity (ρs) of $1\times10^5$ Ω/□ or less, and the maximum distance between said contributing portion and the charge receiving member is in a range from 5 μm to 60 μm.

Further, the invention provides a method for charging a charge receiving member comprising the steps of:

providing a conductive member which has a surface including a contact portion to be in contact with said charge receiving member and a contributing portion, said contributing portion having a surface resistivity (ρs) of $1\times10^5$ Ω/□ or less;

setting said conductive member so that said contact portion is in contact with the charge receiving member and so that said contributing portion faces the charge receiving member; and applying an electrical power consisting of a direct current component to said conductive member to charge said charge receiving member through said contributing portion, the difference potential between said electrical power applied by said power source and a surface potential of the charge receiving member before charged by the application of said electrical power is in a range from 550 v to 750 v.

Further, the invention provides a charging device for charging a charge receiving member comprising:

an electrical power source for supplying an electrical power consisting of a direct current component; and a contact member which is electrically connected with said electrical power source, said contact member having a surface including a contact portion and a contributing portion, said contact portion being for contacting with the charge receiving member, said contributing portion being for facing to the charge receiving member and being in a vicinity of said contact portion, said contributing portion contributing to charge the charge receiving member;

wherein said contributing portion has a surface resistivity (ρs) of $1\times10^5$ Ω/□ or less, and the difference potential between said electrical power applied by said electrical power source and a surface potential of the charge receiving member before charged by said charging device is in a range from 550 v to 750 v.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
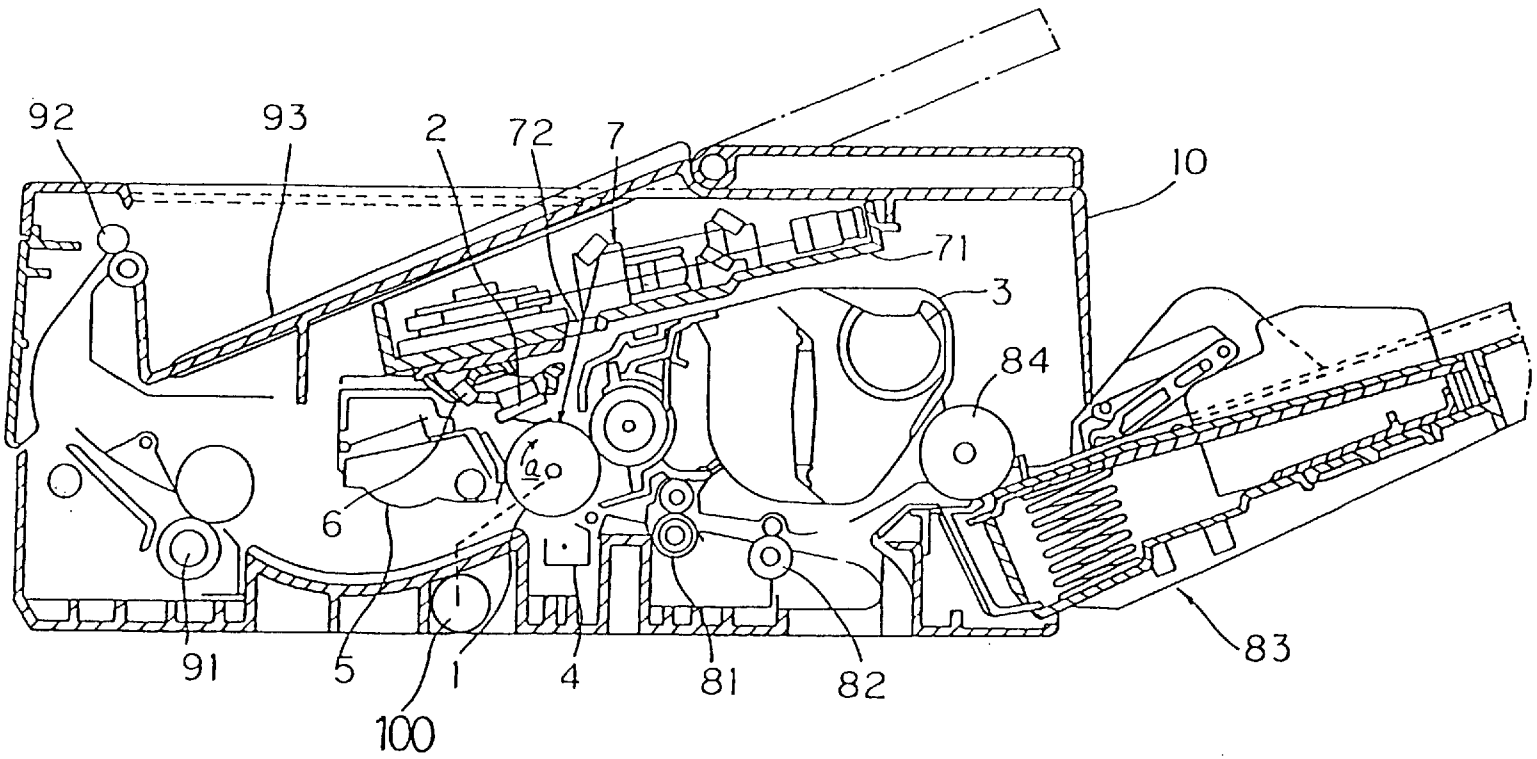
FIG. 1 shows a schematic structure of an example (printer) of an image forming apparatus equipped with a contact charging device according to the invention.

A charging device of an embodiment of the invention includes a power source for supplying a power formed of a DC component, and a contact member which is electrically connected to the power source. The contact member has a contact portion to be in contact with a charge receiving member, and a contributing portion which faces the charge receiving member, is located at the vicinity of the contact portion and contributes to charging of the charge receiving member.

The contributing portion has a surface resistivity (ρs) of $1\times10^5$ Ω/□ or less, and a maximum distance between the contributing portion and the charge receiving member is in a range from 5 μm to 60 μm.

According to this charging device, the portion contributing to charging of the contact member for charging is required to have the surface resistivity (ρs) of $1\times10^5$ Ω/□ or less ($0<\rho s\leqq 1\times10^5$ Ω/□). In connection with the lower limit, metal is usually employed as the material of a low resistance for the charging member, and therefore the material generally has a surface resistivity of $1\times10^{-5}$ Ω/□ or more. In view of this, it can be considered that the surface resistivity ρs of the portion contributing to charging of the contact member is practically selected in a range substantially from $1\times10^{-5}$ Ω/□ to $1\times10^5$ Ω/□.

Although the material having the surface resistivity (ρs) of $1\times10^5$ Ω/□ or less can be selected from a wide range but may cause scale-like charging irregularity if no consideration is given to the contact member made of this material.

If the maximum distance of the gap between the charge contributing portion and the charge receiving member is in a range from 5 μm to 60 μm as described above, it is possible to suppress sufficiently the scale-like charging irregularity regardless of the specific kind of the contact member of which portion contributing to the charging has the surface resistivity (ρs) of $1\times10^5$ Ω/□ or less.

If the maximum distance of the gap were larger than 60 μm, scale-like charging irregularity which was practically unigonorable would occur. If the maximum distance of the gap were smaller than 5 μm, the charge receiving member would not be charged sufficiently and therefore it would be difficult to use the same.

The contact member for charging in the charging device may be selected from various members such as a blade-like member, roller-like member or a sheet-like member.

The charge contributing portion of the contact member for charging can be defined in such a manner that an electrically insulating layer(s) may be arranged to cover a surface(s) facing the charge receiving member at a position(s) upstream and/or downstream to the charge contributing portion in the relative moving direction of the charge receiving member surface with respect to the contact member, or that an electrically insulating member such as an electrically insulating film or sheet may be interposed between the surface of the contact member, which faces the charge receiving member, and the charge receiving member.

According to this charging device (according to the method of the invention if the contact member is electrically conductive), the contact member is arranged in contact with the charge receiving member, an electric power formed of a DC component is applied from the power source to the contact member, and the contact member and the charge receiving member are relatively moved, so that the surface of the charge receiving member is charged. In spite of the conditions that the portion of the contact member contributing to the charging has the surface resistivity (ρs) of $1\times10^5$ Ω/□ or less, i.e., in spite of the conditions which may cause or may be liable to cause scale-like charging irregularity in the prior art, the scale-like charging irregularity is suppressed to a practically accepted extent, because the maximum value of the gap distance between the charge contributing portion and the charge receiving member is restricted in a range from 5 μm to 60 μm. Since the surface resistivity (ρs) of the portion of the contact member contributing to the charging can be selected from a wide range from 0 Ω/□ to $1\times10^5$ Ω/□, the material of the contact member can be selected from a wide range. Within this range, it is possible to produce the contact member made of a material having a high resistance against wear and scratch (e.g., metal) or an inexpensive material.

The contact member may be typically a sheet-like member, which is advantageous in view of reduction in size and cost of the device.

The sheet-like member may be supported by a supporting member in a cantilever manner. In this case, the contact member is generally arranged to be partially in contact with the charge receiving member.

Figure 3:
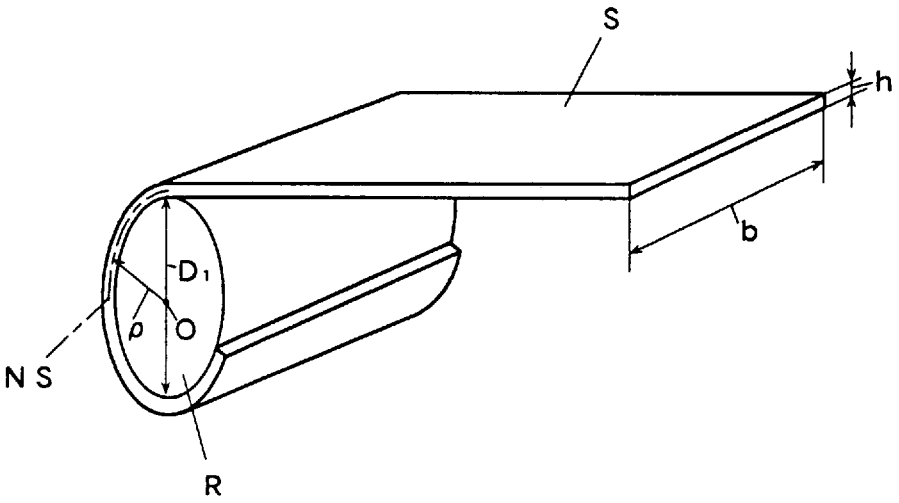
FIG. 3 shows a film material forming a film charging member.
Figure 4:
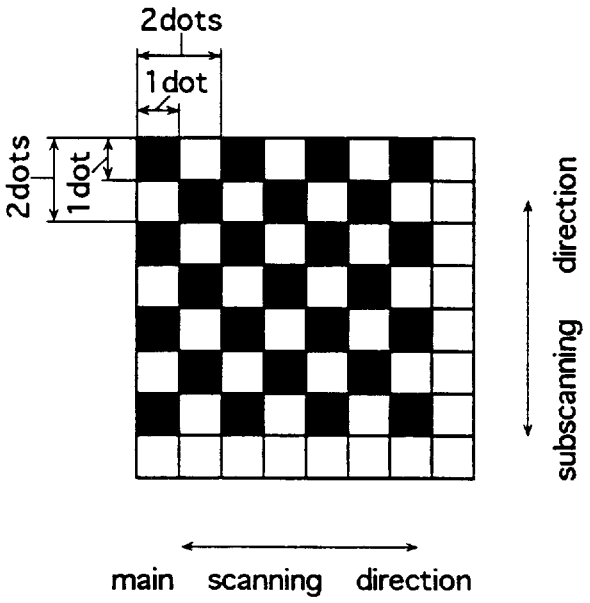
FIG. 4 shows a mesh image.

The sheet-like member may have a flexibility and, for example, may be a flexible film charging member, in which case a bending moment required for bending the same may be smaller than about 20 g.cm and more preferably about 10 g.cm as will be described later with reference to FIG. 3. Naturally, it must have mechanical strengths against breakage, tear and others required for the charging contact member.

In any case, the contact member may be made of metal such as stainless steel, or may be made of organic material (e.g., polyimide resin) containing electrically conductive carbon powder dispersed therein.

Similarly to the aforementioned embodiment, a contact charging device of another embodiment of the invention includes a power source for supplying a power formed of a DC component, and a contact member which is electrically connected to the power source. The contact member has a contact portion to be in contact with a charge receiving member, and a contributing portion which faces the charge receiving member, is located at the vicinity of the contact portion and contributes to charging of the charge receiving member. In the charging device, however, the charge contributing portion has a surface resistivity (ρs) of $1\times10^5$ Ω/□ or less, and the difference potential between the voltage applied by said electrical power source and a surface potential at the surface of the charge receiving member before charging by said charging device is in a range from 550 v to 750 v.

The contact members for charging may be two or more in number, in which case each of the charge contributing portions of the members has a surface resistivity (ρs) of $1\times10^5$ Ω/□ or less, and the difference potential between the voltage applied to the contact member by said electrical power source and a surface potential of the charge receiving member before charging by said contact member is in a range from 550 v to 750 v. If the voltage application conditions satisfying the voltage between 550 v and 750 v result in such a situation that a predetermined practical potential cannot be attained at the surface of the charge receiving member by only one contact member, two or more charging contact members are employed for increasing the surface potential of the charge receiving member in a step-wise fashion.

In any case, the surface resistivity (ρs) of the portion contributing to charging of the contact member is required to be in a range from 0 Ω/□ to $1\times10^5$ Ω/□ ($0<\rho s\leqq1\times10^5$ Ω/□), and its practical lower limit is defined by the material of the contact member having a low resistance which is generally metal having a resistance of about $1\times10^{-5}$ Ω/□. In view of this, it can be considered that the appropriate surface resistivity ρs of the surface contributing to charging of the contact member is practically in a range from $1\times10^{-5}$ Ω/□ to $1\times10^5$ Ω/□, although not restricted to this ranged.

The material having the surface resistivity (ρs) of $1\times10^5$ Ω/□ or less can be selected from a wide range, but this material may cause scale-like charging irregularity if no consideration is given to the charging member made of this material.

If the potential difference between the surface potential of the charge receiving member before charging by the contact member and the DC voltage applied to the contact member is in a range from 550 v to 750 v, the portion of the contact member contributing to the charging can be in the range from 0 Ω/□ to $1\times10^5$ Ω/□ ($0<\rho s\leqq1\times10^5$ Ω/□) while sufficiently suppressing scale-like charging irregularity regardless of the specific kind of the material of the contact member which can be selected from various kinds of material.

If the potential difference were larger than 750 v, practically unignorable charging irregularity in a scale-like form would occur. If the potential difference were smaller than 550 v, the charge receiving member would not be charged sufficiently and therefore would not operate properly.

In the charging device, the contact member can be specifically selected from various kinds of members such as a blade member, a roller-like member and a sheet-like member.

According to this charging device (according to the method of the invention if the contact member is electrically conductive), the contact member for charging is arranged in contact with the charge receiving member, an electric power formed of a DC component is applied from the power source to the contact member, and the contact member and the charge receiving member are relatively moved, so that the surface of the charge receiving member is charged. In spite of the conditions that the portion of the contact member contributing to the charging has the surface resistivity (ρs) of $1\times10^5$ Ω/□ or less, i.e., in spite of the conditions which would cause or might cause scale-like charging irregularity in the prior art, the scale-like charging irregularity is suppressed to a practically allowed extent, because the difference potential between the DC voltage applied to the contact member and the surface potential of the charge receiving member before charging by said contact member is in a range from 550 v to 750 v. Since the surface resistivity (ρs) of the portion of the contact member contributing to the charging can be selected from a wide range from 0 Ω/□ to $1\times10^5$ Ω/□ ($0<\rho s\leqq1\times10^5$ Ω/□), the material of the contact member can be selected from a wide range. Within this range, it is possible to produce the contact member made of a material having a high resistance against wear and scratch (e.g., an appropriate kind of metal) or an inexpensive material.

Similarly to the foregoing charging device, the contact member may be typically a sheet-like member.

The sheet-like member may be supported by a supporting member in a cantilever manner.

The sheet-like member may have a flexibility and, for example, may be a flexible film charging member, in which case a bending moment required for bending the same may be smaller than about 20 g.cm and more preferably about 10 g.cm as will be described later with reference to FIG. 3. Naturally, it must have mechanical strengths against breakage, tear and others required for the charging contact member.

In any case, the contact member may be made of metal such as stainless steel, or may be made of organic material (e.g., polyimide resin) containing electrically conductive carbon powder dispersed therein.

The "charge receiving member" in the above description is typically an electrostatic latent image carrier such as a photosensitive member, but is not restricted thereto. The charging device of the invention can be applied to various charge receiving members which requires prevention or suppression of scale-like charging irregularity.

Preferred embodiments of the invention will be further described below with reference to the drawings.

Each of charging devices which will be described later is mounted in a printer shown in FIG. 1.

Figure 2:
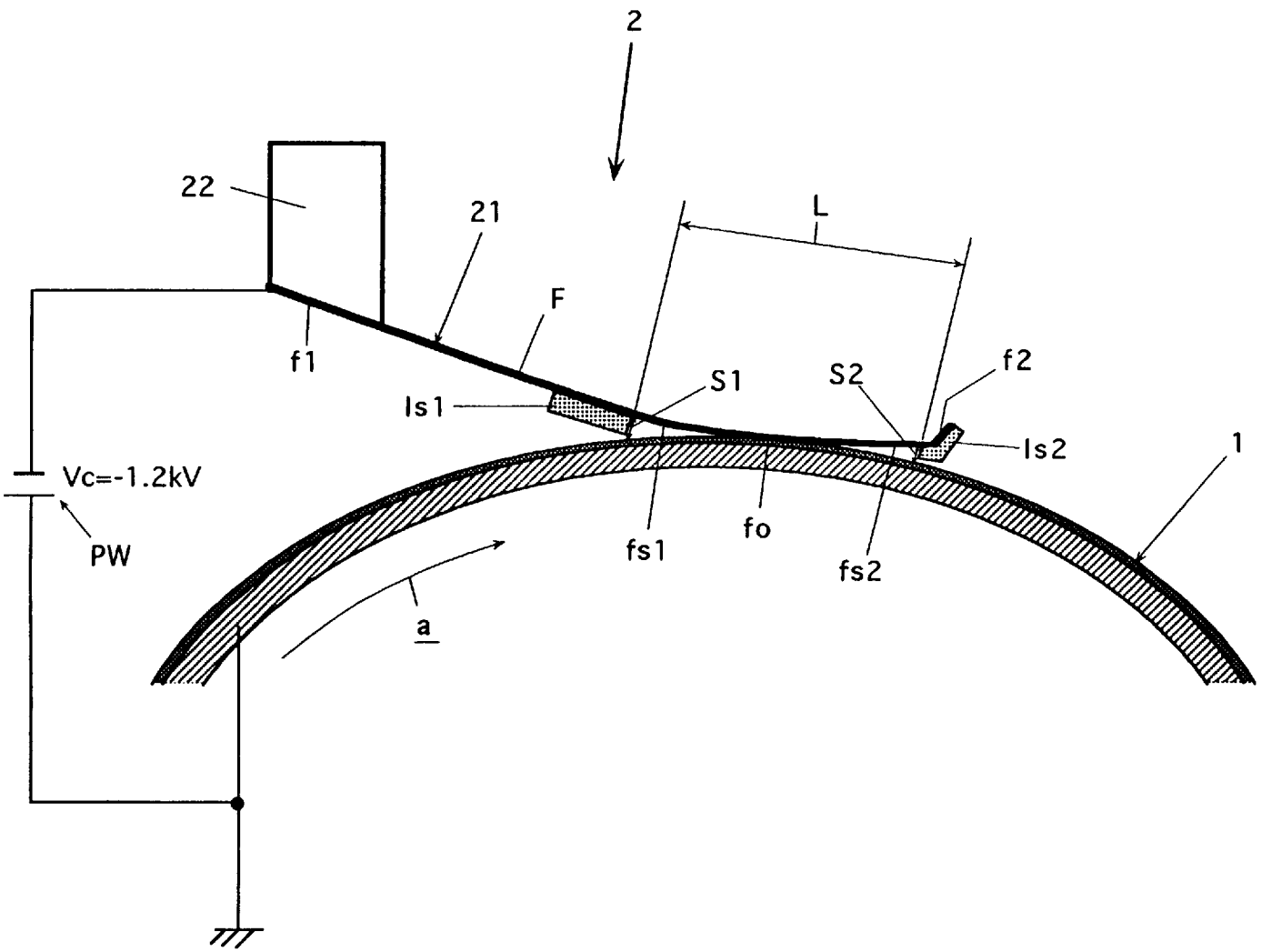
FIG. 2 is a schematic side view of the example of the contact charging device according to the invention.

The printer shown in FIG. 1 is provided at its center with a photosensitive drum 1 which is an electrostatic latent image carrier (charge receiving member). The drum 1 is driven to rotate in a direction of an arrow a by a main electric motor 100. A charging device 2, a developing device 3, a transfer charger 4, a cleaning device 5 and an eraser 6 are successively arranged around the drum 1. The charging device 2 is a contact charging device according to the invention, and has a charging member 21 as shown in FIG. 2. For image formation, a DC voltage $V_c$ is applied to the member 21 from a power source PW. The charging device 2 will be described later.

An optical system 7 is arranged above the photosensitive drum 1. The optical system 7 includes a housing 71, which accommodates a semiconductor laser generating device, a polygonal mirror, a toroidal mirror, a half mirror, a spheric mirror, a return mirror, a reflection mirror and others. The housing 71 is provided at its floor with an exposure slit 72, through which image exposure is performed on the photosensitive drum 1 also through a space between the charging device 2 and the developing device 3.

A timing roller pair 81, an intermediate roller pair 82 and a sheet supply cassette 83 are successively arranged at the right of the photosensitive drum 1 in the figure. A sheet feed roller 84 is opposed to the sheet supply cassette 83. A fixing roller pair 91 and a sheet discharge roller pair 92 are successively arranged at the left of the photosensitive drum 1 in the figure. A sheet discharge tray 93 is opposed to the sheet discharge roller pair 92. The parts described above are arranged in a main printer unit 10.

According to this printer, the surface of the photosensitive drum 1 is charged to a predetermined potential by the charging device 2, and the optical system 7 performs image exposure on the charged area to from an electrostatic latent image. The electrostatic latent image thus formed is developed by the developing device 3 into a toner image, which is moved to a transfer region opposed to the transfer charger 4.

The sheet feed roller 84 pulls the transfer sheet from the sheet feed cassette 83. The transfer sheet moves through the intermediate roller pair 82 to the timing roller pair 81, and then is fed to the transfer region in synchronization with the toner image on the drum 1. Owing to the operation of the transfer charger 4 at the transfer region, the toner image on the drum 1 is transferred onto the transfer sheet and fixed on the sheet by the fixing roller pair 91, and then the sheet is discharged to the sheet discharge tray 93 by the sheet discharge roller pair 92.

After the toner image is transferred onto the transfer sheet, toner remaining on the photosensitive drum 1 is cleaned up by the cleaning device 5. An eraser 6 erases residual electric charges.

A system speed of the printer (i.e., peripheral speed of the photosensitive drum 1) is 3.5 cm/sec. The voltage $V_c$ applied to the charging member 21 of the charging device 2 is a DC voltage. The developing device 3 is a one-component contact developing device performing reversal development.

The photosensitive drum 1 is of a function-separated type for negative charging, and has a sensitivity to long-wave light. A charge generating layer is formed of mixture of τ-type non-metal phthalocyanine and polyvinyl butyral resin, and has a thickness of about 0.4 μm. A charge transporting layer is formed of mixture which principally contains hydrazone compound and polycarbonate resin, and has a thickness of about 18 μm. The electrostatic latent image carrier to which the charging device of the invention can be applied is not restricted to the above structure.

The toner used in the developing device 3 is of a negative type, and is formed of mixture principally containing bisphenol A polyester resin and carbon black. The mixture is kneaded, ground and classified by a known method to produce toner particles having a mean diameter of 10 μm.

The toner thus prepared is accommodated in the developing device 3, which performs developing with a developing bias $V_B$. For image formation corresponding to the image exposure, the developing bias potential $V_B$ is selected from a range from −250 v to −350 v. This developing bias potential may depend on each device, or may be appropriately determined in the above range depending on an environmental variation.

The contact charging device 2 will be further described. As shown in FIG. 2, the contact member for charging is a sheet-like member (i.e., film charging member 21 in this embodiment). The film charging member 21 has the following specific structure. A film F having predetermined sizes is supported at one end f1 by a supporting member 22 in a cantilever manner. A free end f2 of the film F is bent upward and the film is brought into contact with the surface of the photosensitive drum 1. A power source PW applies a DC voltage of −1.2 kv to the charging member 21 as described below.

The film F (charging member 21) has a portion fo which is in contact with the surface of the photosensitive drum 1, and regions of the film F upstream and downstream to the portion fo in the photosensitive drum surface moving direction a form charge contributing surfaces fs1 and fs2. A boundary of the charge contributing surface fs1 is defined by an electric insulating layer ls1 which is formed on the film surface at a position upstream to the surface fs1 in the photosensitive drum surface moving direction a. A boundary of the charge contributing surface fs2 is defined by an electric insulating layer ls2 which is formed on the film surface at a position downstream to the surface fs2 in the photosensitive drum surface moving direction a and extends up to a free end of the film.

A gap having a maximum distance S1 in a range from 5 μm to 60 μm is formed between the charge contributing surface fs1 and the surface of the photosensitive drum 1. Also, a gap having a maximum distance S2 in a range from 5 μm to 60 μm is formed between the charge contributing surface fs2 and the surface of the photosensitive drum 1. Accordingly, the charging contributing surface forms, as a whole, a gap of the maximum distance in a range from 5 μm to 60 μm with respect to the surface of the photosensitive drum 1.

A series of regions of the surface fs1, contact portion fo and surface fs2 has a length L of 5 mm in the photosensitive drum surface moving direction, although not restricted thereto.

The film F forming the charging member 21 is a flexible film as disclosed in U.S. Pat. No. 5,192,974. More specifically, as shown in FIG. 3, the film F has a bending moment Mm of 20 g.cm or less and more preferably of 10 g.cm or less which is required for winding the film having a width b of 1 cm around a core rod R having an outer diameter $D_1$ of 1 cm. It has a sufficient mechanical strength against breakage, tear and others required for the charging member. The bending moment Mm is EI/ρ ($I=bh^3/12$). E represents a modulus of elasticity (young's modulus) ($g/cm^2$) of the film F. I represents a second moment ($cm^4$) of the cross section. ρ represents a curvature radius (cm) equal to a distance between a center O of the core rod R and a neutral surface NS of the film F. h represents a thickness of the film.

The material of the film F is selected such that the surface resistivity (ρs) of the charge contributing surfaces fs1 and fs2 is $1\times10^5$ Ω/□ or less and, in this embodiment, the ρs is in a range from $1\times10^{-5}$ Ω/□ to $1\times10^5$ Ω/□.

The contact charging device 2 employs the film charging member 21 of which charge contributing surface has the surface resistivity (ρs) in a range from $1\times10^{-5}$ Ω/□ to $1\times10^5$ Ω/□, and in other words, employs the charging member 21 which may cause or may be liable to cause scale-like charging irregularity in the prior art. In spite of this fact, since the maximum value of the gap between the charge contributing surface and the photosensitive drum 1 is restricted in a range from 5 μm to 60 μm, scale-like charging irregularity at the surface of the photosensitive drum 1 can be sufficiently suppressed.

Description will now be given on experimental examples which prove that the charging device 2 can sufficiently suppress the scale-like charging irregularity owing to the fact that the charging member 21 has the charge contributing surface having the aforementioned surface resistivity and forming the gap of the aforementioned maximum distance with respect to the photosensitive drum 1. In these experimental examples 1-1 to 1-4, the charging members were formed of films F of various kinds of materials, and various maximum values of the gap distances were employed. These experimental examples are shown in the following table 1 together with comparative experimental examples 1-1 and 1-2 which were performed for comparison.

All the experiments were performed with the printer already described. The system speed, toner used in the developing devices and others were the same as those already described. However, the voltage $V_c$ applied to the charging member was −1.2 kv, and the developing bias voltage $V_B$ was set to −700 v similar to the charging potential applied to the photosensitive drum 1 by the charging member 21. Images for evaluating charged states were prepared by printing white solid images for evaluating uniformity in charged potential.

The following four kinds of films A, B, C and D were employed as the charging members for experiments.

A: stainless steel film of 20 μm in thickness surface resistivity $\rho s=1\times10^{-5}$ Ω/□

B: polyimide film containing conductive carbon powder dispersed therein and having a thickness of 30 μm surface resistivity $\rho s=1\times10^3$ Ω/□

C: polyimide film containing conductive carbon powder dispersed therein and having a thickness of 30 μm surface resistivity $\rho s=1\times10^5$ Ω/□

D: polyimide film containing conductive carbon powder dispersed therein and having a thickness of 30 μm surface resistivity $\rho s=1\times10^7$ Ω/□

When the scale-like charging irregularity occurs, scale-like noises appear at the image for evaluating the charged state. Therefore, the charging performance was evaluated by observing the scale-like noises at the images. Description will now be given on a method of evaluating the scale-like noises at the image based on the scale-like charging irregularity on the surface of the photosensitive drum 1.

(Method of Evaluating Scale-Like Noises)

The developing bias voltage $V_B$ of the developing device 3 of the printer was set to a value for evaluating the charged state, and more specifically was set to −700 v similar to the charged potential of the photosensitive drum 1 charged by the charging member 21. White solid images were prepared (no exposure was performed), and thereby so-called bias developing was performed with the original potential charged by the charging member. Thereby, images for evaluating the charged state were prepared and printed on transfer sheets for evaluating the uniformity in charged potential. The image for evaluating the charged state would be formed of toner uniformly adhering to the whole transfer sheet, if a uniform charged state was attained. Conversely, an irregular charged state would result in an irregular image including a white blank at a high-charged portion and a black portion at a low-charged portion. The images for evaluating the charged state on the transfer sheets were visually observed, and were ranked as follows. A mark "O" represents an acceptable image. Marks "Δ" and "X" represent practically unacceptable images.

O: No scale-like noise was present. (No scale-like charging. Uniform charging)

Δ: Scale-like noises were partially present. (Scale-like charging irregularity was partially present.)

X: Scale-like noises were entirely present. (Scale-like charging irregularity was entirely present.)

TABLE 1

| | Image Evaluation | | | |
|---|---|---|---|---|
| Maximum Gap Distance | A | B | C | D |
| EX 1-1 5 μm | O | O | O | Not Evaluated |
| EX 1-2 20 μm | O | O | O | Not Evaluated |
| EX 1-3 40 μm | O | O | O | Not Evaluated |
| EX 1-4 60 μm | O | O | O | Not Evaluated |
| CE 1-1 80 μm | X | Δ | Δ | Not Evaluated |
| CE 1-2 (No Is1 and Is2) | X | X | Δ | O |

EX: experimental example
CE: comparative experimental example

From the above results of experiments, the following can be understood. Even if the charge contributing surface of the film charging member 21 has the surface resistivity ρs in a range from $1\times10^{-5}$ Ω/□ to $1\times10^5$ Ω/□, the scale-like charging irregularity can be sufficiently suppressed by restricting the maximum value of the gap distance between the charge contributing surface and the photosensitive drum 1 in a range from 5 μm to 60 μm. Although not shown, the scale-like charging irregularity can be sufficiently suppressed by restricting the maximum value of the gap distance between the charge contributing surface and the photosensitive drum 1 in a range from 5 μm to 60 μm, even if the charge contributing surface has the surface resistivity ρs smaller than $1\times10^{-5}$ Ω/□. In the aforementioned experiments, the film D was not evaluated in connection with the case of the gap maximum distance from 5 μm to 80 μm, and scale-like charging irregularity did not occur in the comparative experimental example 1-2, because the film D has a large surface resistivity of $1\times10^{7}$ Ω/□, and can prevent or suppress the scale-like charging irregularity owing to its own properties regardless of the magnitude of the gap.

Description has been given on the contact charging device having the charging member formed of the film charging member 21. However, the form of the charging member is not restricted to the film. In connection with this, other examples of contact charging members according to the invention will be described below.

Figure 5:
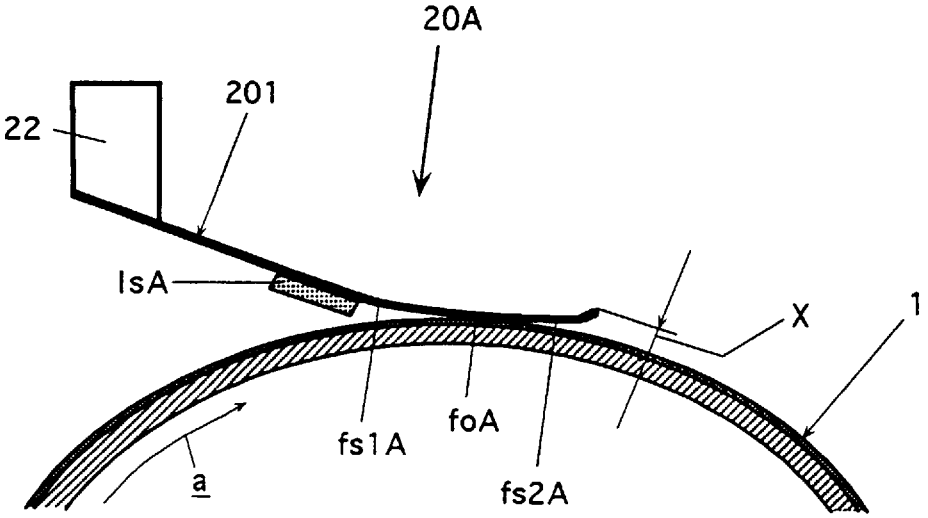
FIG. 5 is a side view of another example of a charging device according to the invention.

A charging device 20A shown in FIG. 5 is similar to the foregoing charging device 2 except for that a film charging member 201 is employed instead of the film charging member 21. The charging member 201 has an electric insulating layer IsA which is opposed to the photosensitive drum and is located at a position upstream to a portion foA to be in contact with the surface of the photosensitive drum 1 in the moving direction a of the photosensitive drum surface, and also has charge contributing surfaces fs1A and fs2A which are located downstream to the layer IsA and more specifically at positions upstream and downstream to the contact portion foA. In this case, the free end surface of the charging member 201 is included in the charge contributing surface fs2A, so that a distance X from the upper end of the free end surface to the surface of the photosensitive drum 1 is restricted in a range from 5 μm to 60 μm.

Figure 6:
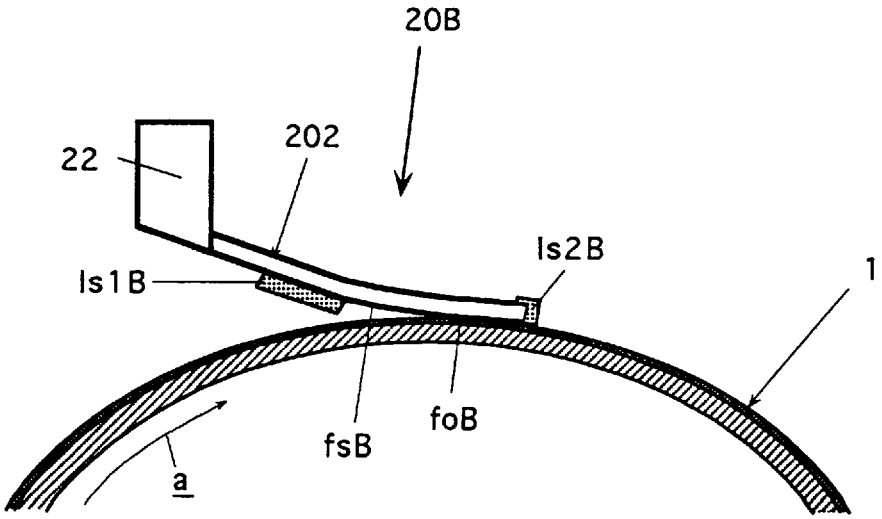
FIG. 6 is a side view of still another example of a charging device according to the invention.

A charging device 20B shown in FIG. 6 is similar to the charging device 2 except for that a thick blade charging member 202 is employed instead of the film charging member 21. The charging member 202 has an electric insulating layer Is1B which is opposed to the photosensitive drum and is located at a position upstream to a portion foB to be in contact with the surface of the photosensitive drum 1 in the moving direction a of the photosensitive drum surface, and also has an electric insulating layer Is2B at the end surface of the free end and the upper surface of the blade. Charge contributing surface(s) fsB is located upstream to the contact portion foB of the blade or are located downstream and upstream to the contact portion foB.

Figure 7:
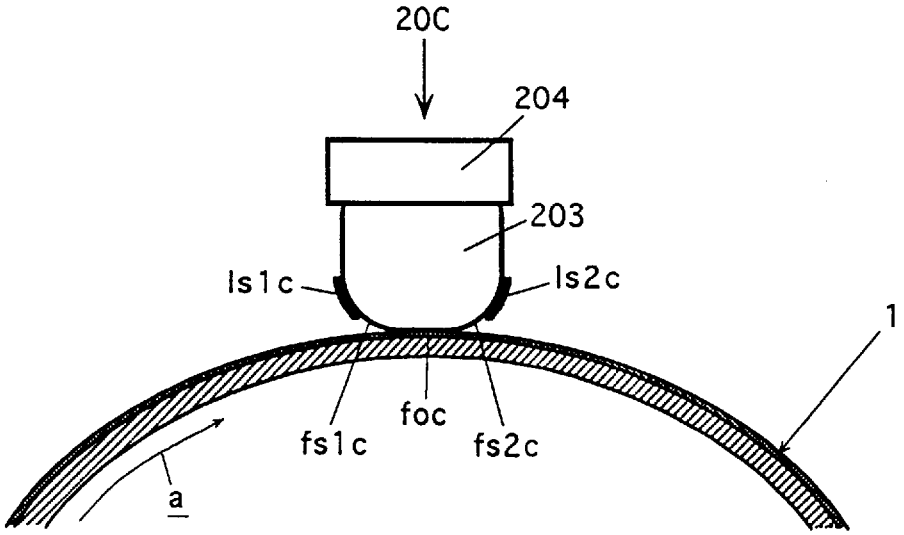
FIG. 7 is a side view of yet another example of a charging device according to the invention.

A charging device 20C shown in FIG. 7 employs a charging member 203, which is formed of an electrically conductive and elastic member having a rounded square section provided with a slowly curved top surface. The charging member 203 is supported by a supporting member 204 in such a manner that a portion foC of its top surface is in contact with the surface of the photosensitive drum 1. This charging member 203 is provided with electrically insulating layers Is1C and Is2C which are located at corner portions of the top surface upstream and downstream to the contact portion foC in the photosensitive drum surface moving direction a, and charge contributing surfaces fs1C and fs2C are formed upstream and downstream to the contact portion foc.

Figure 8:
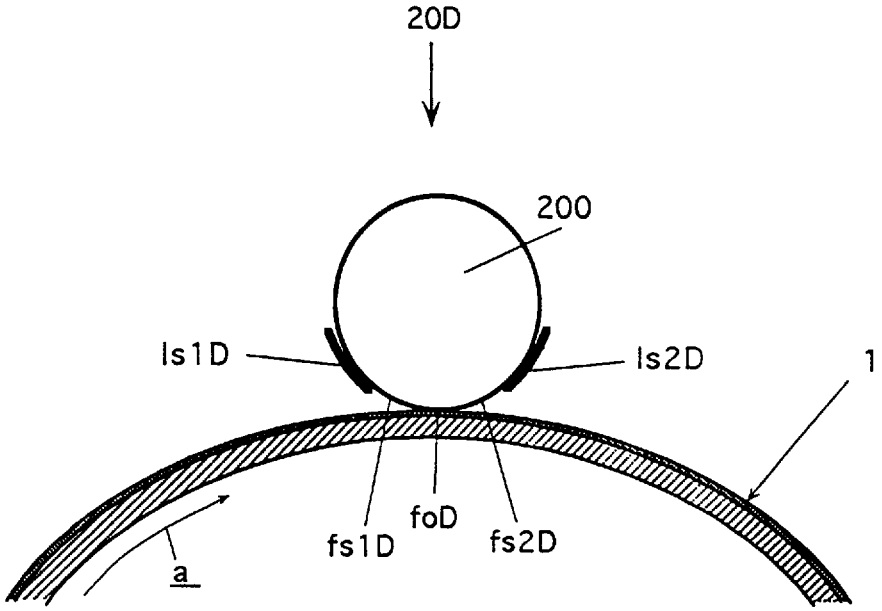
FIG. 8 is a side view of further another example of a charging device according to the invention.
Figure 9:
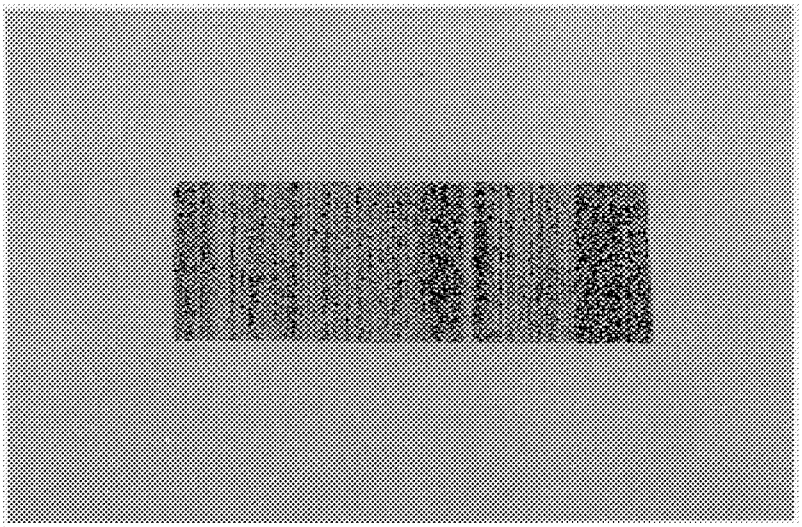
FIG. 9 shows an example of an image containing scale-like noises.

A charging device 20D shown in FIG. 8 has a rotatable roller charging member 200 which can rotate with its portion foD in contact with the photosensitive drum 1. This charging member 200 is provided with electrically insulating layers Is1D and Is2D which are located at portions of the roller surface upstream and downstream to the contact portion foD in the photosensitive drum surface moving direction a, and charge contributing surfaces fs1D and fs2D are formed upstream and downstream to the contact portion foD.

Each of the charging devices shown in FIGS. 5 to 8 can suppress the scale-like charging irregularity owing to the features that the surface of the charging member contributing to charging has the surface resistivity (ρs) of $1\times10^{5}$ Ω/□ or less, and that the maximum value of the gap distance between the charge contributing surface and the photosensitive drum 1 is in the range from 5 μm to 60 μm.

Still another example of the charging device will be described below with reference to FIG. 10.

Figure 10:
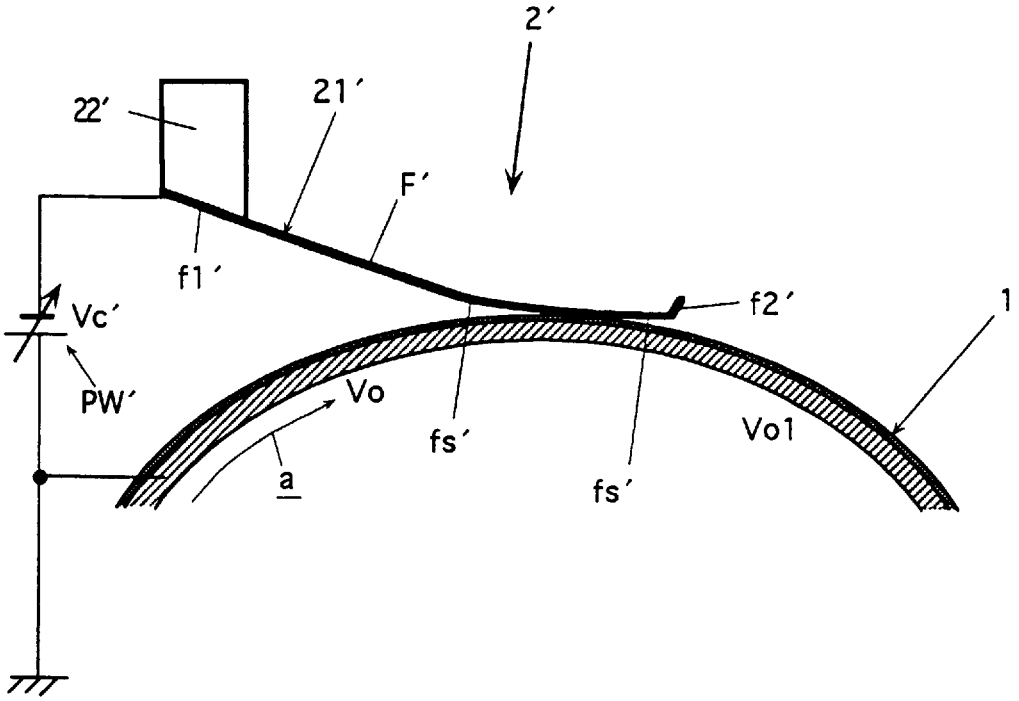
FIG. 10 is a side view of a further example of a charging device according to the invention.

A charging device 2' shown in FIG. 10 has the following specific structure. Similarly to the foregoing film F, a film F' having predetermined sizes and forming a film charging member 21' is supported at one end f1' by a supporting member 22' in a cantilever manner. A free end f2' of the film F' is bent upward and is brought into contact with the surface of the photosensitive drum 1. A power source PW' applies a DC voltage Vc' to the charging member 21'.

The voltage Vc' applied to the charging member 21' is set to attain such a state that a potential difference Δv in a range from 550 v to 750 v is formed between the surface potential Vo of the photosensitive drum 1, which is to be charged by the charging member 21', before charging by the charging member 21' and the voltage Vc'.

The film F' forming the charging member 21' is a flexible film as disclosed in U.S. Pat. No. 5,192,974. More specifically, in order to achieve good contact with the charge receiving member, the film F' has a bending moment Mm of 20 g.cm or less and more preferably of 10 g.cm or less required for winding the film having a width b of 1 cm around a core rod R having an outer diameter $D_1$ of 1 cm. It has a sufficient mechanical strength against breakage, tear and others required for the charging member.

The material of the film F' is selected such that the surface resistivity (ρs) of the charge contributing surface fs' satisfies a relationship of $0\ \Omega/\square<\rho s\leqq1\times10^{5}\ \Omega/\square$ and, in this embodiment, the ρs is in a range from $1\times10^{-5}$ Ω/□ to $1\times10^{5}$ Ω/□.

As described above, the contact charging device 2' employs the film charging member 21' of which charge contributing surface fs' has the surface resistivity ρs in a range from $1\times10^{-5}$ Ω/□ to $1\times10^{5}$ Ω/□, and in other words, employs the charging member 21' which may cause or may be liable to cause scale-like charging irregularity in the prior art. In spite of this fact, scale-like charging irregularity can be sufficiently suppressed, because a potential difference ΔV in the range from 550 v to 750 v is formed between the surface potential Vo of the photosensitive drum 1, which is to be charged by the charging member 21', before charging by the charging member 21 and the voltage Vc'.

Description will now be given on experimental examples which prove that the charging device 2' can sufficiently suppress the scale-like charging irregularity owing to the fact that the charging member 21' has the charge contributing surface fs' having the aforementioned surface resistivity ρs and is subjected to the foregoing voltage. In these experimental examples 2-1 to 2-4, the charging members were formed of films F' of various kinds of materials, and the voltages Vc' of various values were employed. These experimental examples are shown in the following table 2 together with comparative experimental examples 2-1 and 2-2 which were performed for comparison.

All the experiments were performed with the printer already described. As shown in the table 2, the developing voltage $V_B$ was set to a value similar to the charging potential applied to the photosensitive drum 1 by the charging member 21'. Images for evaluating charged states were prepared by printing white solid images for evaluating uniformity in charged potential. The toner used in the developing device was the same as that already described. The surface potential Vo of the photosensitive drum 1 before charging by the charging member 21' is 0 v. In the table 2, Vo1 represents the charged potential of the surface of the drum 1 after passing through the charging member 21'.

The following four kinds of films A', B', C' and D' were employed as the charging members for experiments.

A': stainless steel film of 20 μm in thickness surface resistivity ρs=1×10$^{-5}$ Ω/□

B': polyimide film containing conductive carbon powder dispersed therein and having a thickness of 30 μm surface resistivity ρs=1×10$^{3}$ Ω/□

C': polyimide film containing conductive carbon powder dispersed therein and having a thickness of 30 μm surface resistivity ρs=1×10$^{5}$ Ω/□

D': polyimide film containing conductive carbon powder dispersed therein and having a thickness of 30 μm surface resistivity ρs=1×10$^{7}$ Ω/□

When the scale-like charging irregularity occurs, scale-like noises appear at the image for evaluating the charged state. Therefore, the charging performance was evaluated by observing the scale-like noises at the images. Description will now be given on a method of evaluating the scale-like noises at the image based on the scale-like charging irregularity on the surface of the photosensitive drum 1.

(Method of Evaluating Scale-Like Noises)

The developing bias voltage $V_B$ of the developing device 3 of the printer is set to a value for evaluating the charged state, and more specifically was set to a value similar to the charged potential of the photosensitive drum 1 charged by the charging member 21'. White solid images were prepared (no exposure was performed), and so-called bias developing was performed with the original potential charged by the charging member. Thereby, images for evaluating the charged state were prepared and printed on transfer sheets for evaluating the uniformity in charged potential. The image for evaluating the charged state would be formed of toner uniformly adhering to the whole transfer sheet, if a uniform charged state was attained. Conversely, an irregular charged state would results in an irregular image including a white blank at a high-charged portion and a black portion at a low-charged portion. The images for evaluating charged state on the transfer sheets were visually observed, and were ranked as follows. A mark "O" represents an acceptable image. Marks "Δ" and "X" represent practically unacceptable images.

O: No scale-like noise was present. (No scale-like charging. Uniform charging)

Δ: Scale-like noises were partially present. (Scale-like charging irregularity was partially present.)

X: Scale-like noises were entirely present. (Scale-like charging irregularity was entirely present.)

TABLE 2

| | Vo | Vc' | \|Vc' − Vo\| | Vo1 | $V_B$ | Evaluation A' | B' | C' | D' | Remarks |
|---|---|---|---|---|---|---|---|---|---|---|
| EX 2-1 | 0 v | −500 v | 500 v | 0 v | 0 v | N/E | N/E | N/E | N/E | Vo1 = 0 |
| EX 2-2 | 0 v | −550 v | 550 v | −60 v | −50 v | O | O | O | N/E | |
| EX 2-3 | 0 v | −650 v | 650 v | −130 v | −100 v | O | O | O | N/E | |
| EX 2-4 | 0 v | −750 v | 750 v | −220 v | −200 v | O | O | O | N/E | |
| CE 2-1 | 0 v | −800 v | 800 v | −410 v | −300 v | Δ | Δ | Δ | N/E | |
| CE 2-2 | 0 v | −1000 v | 1000 v | −600 v | −500 v | X | X | Δ | O | |

N/E: not evaluated

From the above results of experiments, the following can be understood. Even if the charge contributing portion of the film charging member 21' has the surface resistivity ρs in a range from 1×10$^{-5}$ Ω/□ to 1×10$^{5}$ Ω/□, the scale-like charging irregularity can be sufficiently suppressed by setting the potential difference ΔV in the range from 550 v to 750 v between the surface potential Vo of the photosensitive drum 1, which is to be charged by the charging member 21', before charging by the charging member 21' and the voltage Vc'. Although not shown, the scale-like charging irregularity can be suppressed by restricting the potential difference in the range from 550 v to 750 v, even if the charge contributing surface has the surface resistivity ρs smaller than 1×10$^{-5}$ Ω/□. In the aforementioned experiments, the film D' was not evaluated in connection with the case of the potential difference ΔV from 550 v to 800 v, and scale-like charging irregularity did not occur in the comparative experimental example 2-2, because the film D' has a large surface resistivity of 1×10$^{7}$ Ω/□, and can prevent or suppress the scale-like charging irregularity owing to its own properties regardless of the magnitude of the potential difference.

A still another example of the charging device will be described below with reference to FIG. 11.

Figure 11:
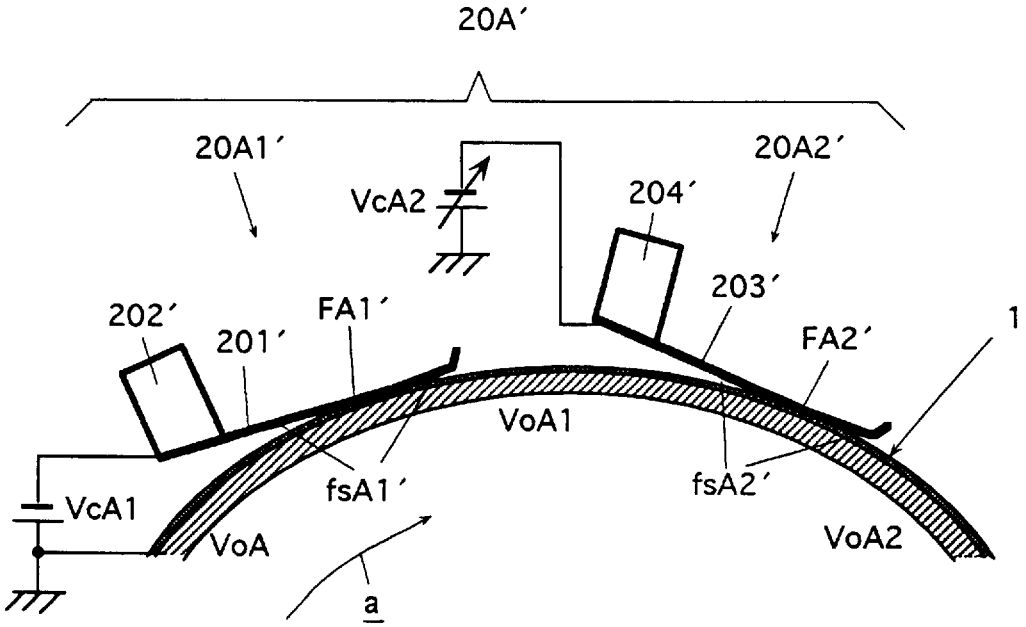
FIG. 11 is a side view of a further example of a charging device according to the invention.

A charging device 20A' shown in FIG. 11 includes two charging devices, each of which has the same form as that shown in FIG. 10. These two devices are arranged along the photosensitive drum surface moving direction a.

A charging portion 20A1' located at an upstream position in the moving direction a of the drum surface has such a structure that a film FA1' having predetermined sizes forms a film charging member 201'. One end of the film FA1' is supported by a support member 202' in a cantilever manner. A free end of the film is bent upward and is brought into contact with the surface of the photosensitive drum 1. A DC voltage VcA1 is applied to the charging member 201'.

A charging portion 20A2' located at a downstream position in the moving direction a of the drum surface has such a structure that a film FA2' having predetermined sizes forms a film charging member 203'. One end of the film FA2' is supported by a support member 204' in a cantilever manner. A free end of the film is bent upward and is brought into contact with the surface of the photosensitive drum 1. A DC voltage VcA2 is applied to the charging member 203'.

The material of each of the films FA1' and FA2' is selected such that the surface resistivity (ρs) of the charge contributing surface fsA1' (fsA2') is 1×10$^{5}$ Ω/□ or less and, in this embodiment, in a range from 1×10$^{-5}$ Ω/□ to 1×10$^{5}$ Ω/□.

The DC voltage VcA1 applied to the charging member 201' is set to attain such a state that a potential difference ΔV in a range from 550 v to 750 v is formed between the surface potential VoA (0 v in this embodiment) of the photosensitive drum 1 before charging by the charging member 201' and the DC voltage VCA1, and this potential difference ΔV is in a range from 550 v to 750 v. The DC voltage VcA2 applied to the charging member 203' is set to attain such a state that a potential difference ΔV in a range from 550 v to 750 v is formed between the surface potential VoA1 of the photosensitive drum 1 before charging by the charging member 203' and the voltage VcA2.

Similarly to the foregoing embodiments, the charging device 20A' can sufficiently suppress scale-like charging irregularity at the surface of the photosensitive drum 1.

Description will now be given on experimental examples 2-5 and 2-6 which prove that the charging device 20A' can sufficiently suppress the scale-like charging irregularity owing to the fact that the charging members 201' and 203' have the charge contributing surfaces fsA1' and fsA2' having the aforementioned surface resistivity ρs and are subjected to the foregoing voltage. These experimental examples 2-5 and 2-6 are shown in the following table 3 together with comparative experimental examples 2-3 and 2-4 which were performed for comparison.

In these examples, the charging member 201' was made of a film A' (stainless steel) employed in the foregoing experimental example 2-1 and others, and the voltage VcA1 of a fixed value of −700 v was applied to the member 201', so that the charging potential VoA1 of a constant value of −170 v was kept at the surface of the drum 1 by the charging member 201'. Three kinds of films A', B' and C' employed in the foregoing experimental examples 2-1 and others were employed as the charging members 203'. Voltages VcA2 of various values were applied to these films.

The printer already described was used in all the experiments. The developing bias voltage $V_B$ was set to a value similar to the charged potential VoA2 of the surface of the photosensitive drum 1 charged by the downstream charging member 203'. White solid images were printed for preparing images for evaluating the charged state from which the uniformity in charged potential could be evaluated. The toner and others used in the developing devices were the same as those already described. A method of evaluating images (i.e., evaluating charging irregularity) was the same as those in the foregoing experimental example 2-1 and others.

TABLE 3

| | VoA | VoA1 | VcA2 | \|VcA2 − VoA1\| | VoA2 | $V_B$ | Evaluation A' | Evaluation B' | Evaluation C' |
|---|---|---|---|---|---|---|---|---|---|
| EX 2-5 | 0 v | −170 v | −800 v | 630 v | −300 v | −250 v | O | O | O |
| EX 2-6 | 0 v | −170 v | −900 v | 730 v | −390 v | −350 v | O | O | O |
| CE 2-3 | 0 v | −170 v | −1000 v | 830 v | −600 v | −500 v | X | Δ | Δ |
| CE 2-4 | 0 v | −170 v | −1200 v | 1030 v | −780 v | −700 v | X | X | X |

From the above results of experiments, the following can be understood. Even if the charge contributing surface of each charging member has the surface resistivity ρs in a range from $1\times10^{-5}$ Ω/□ to $1\times10^{5}$ Ω/□, the scale-like charging irregularity can be sufficiently suppressed by setting the potential difference ΔV in the range from 550 v to 750 v between the surface potential of the photosensitive drum 1, which is to be charged by the charging member, before charging by the charging member and the DC voltage applied to the charging member. Although not shown, the scale-like charging irregularity can be suppressed by restricting the potential difference ΔV in the range from 550 v to 750 v, even if the charge contributing surface has the surface resistivity ρs smaller than $1\times10^{-5}$ Ω/□.

Under the conditions of voltage application, which achieves the potential difference in the range from 550 v to 750 v, it may be impossible to set the intended surface potential of the charge receiving member only by one charging member. In this case, two or more charging members are employed, and the surface potential of the charge receiving member can be set to the predetermined potential in a step-wise manner by these charging members.

For achieving the surface potential of the charge receiving member to the predetermined potential in a step-wise manner, the contact charging device according to the invention may be used together with a conventional charging device such as a corona charging device or a contact charging device including a high-resistance charging member provided that no practical problem occurs. For example, a contact charging device including a high-resistance charging member may be arranged upstream to the contact charging device according to the invention. According to this structure, the contact charging device according to the invention at the downstream position can cancel charging irregularity in a striped form which may occur due to the contact charging device in the upstream position, so that uniformity in charging can be achieved.

Although description has been given on the contact charging devices including the film charging members, the charging members may have forms other than the film. This will be described below with reference to still another embodiment of the charging device.

Figure 12:
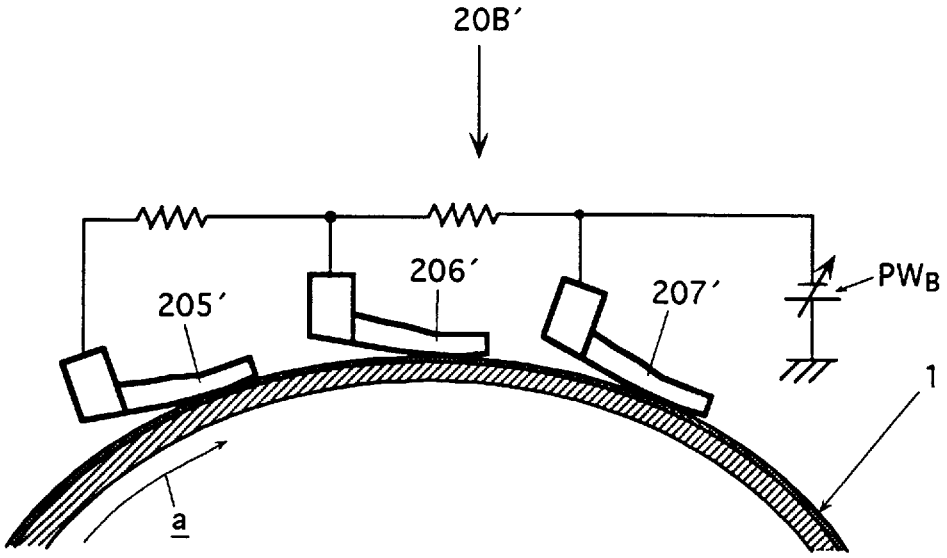
FIG. 12 is a side view of a further example of a charging device according to the invention.

A charging device 20B' shown in FIG. 12 includes three blade charging members 205', 206' and 207' which are made of thick blades and are arranged in the moving direction a of the photosensitive drum surface. Each blade charging member has a portion in contact with the surface of the photosensitive drum 1, and receives a DC voltage from a power source PWB.

Figure 13:
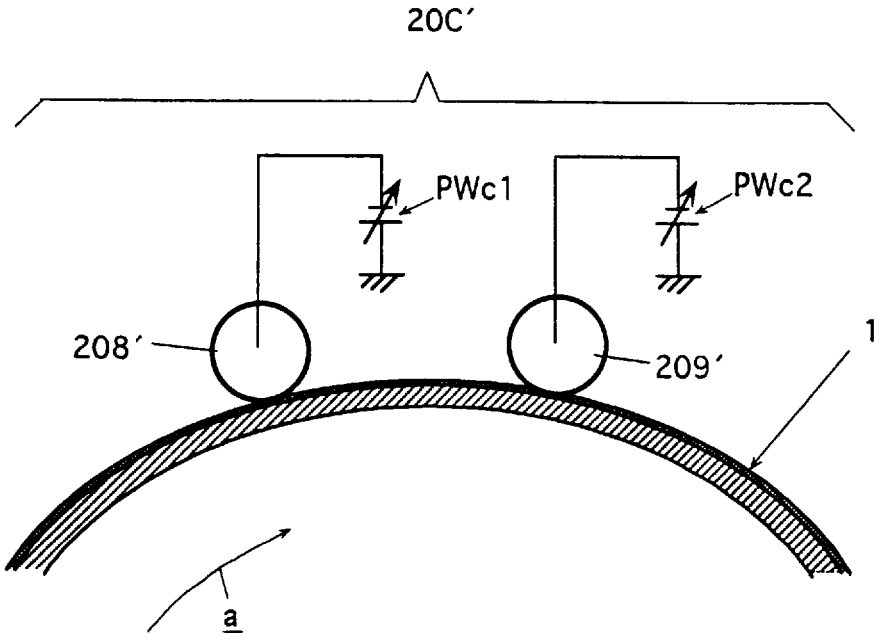
FIG. 13 is a side view of a further example of a charging device according to the invention.

A charging member 20C' shown in FIG. 13 has two roller charging members 208' and 209' arranged along the moving direction a of the photosensitive drum surface. Each roller charging member has a portion in contact with the surface of the photosensitive drum 1, and can rotate along the drum surface moving direction. The charging members 208' and 209' are supplied with DC voltages from power sources PWc1 and PWc2, respectively.

Similarly to the embodiments already described, the charging devices shown in FIGS. 12 and 13 can suppress the scale-like charging irregularity to a practically acceptable degree owing to such conditions that the charge contributing surface of each charging member has the surface resistivity (ρs) of $1\times10^{5}$ Ω/□ or less and the potential difference in the range from 550 v to 750 v is set between the surface potential of the photosensitive drum 1 before charging by the charging member and the DC voltage applied to the charging member.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A charging device for charging a charge receiving member comprising:

an electrical power source for supplying an electrical power consisting of a direct current component; and a contact member which is electrically connected with said electrical power source, said contact member having a surface including a contact portion and a contributing portion, said contact portion being for contacting with the charge receiving member, said contributing portion being for facing to the charge receiving member and being in a vicinity of said contact portion, said contributing portion contributing to charge the charge receiving member;

wherein said contributing portion has a surface resistivity of $1\times10^5$ Ω/□ or less, and the maximum distance between said contributing portion and the charge receiving member is in a range from 5 μm to 60 μm.

2. The charging device as claimed in claim 1, wherein the surface resistivity of said contributing portion is in a range from $1\times10^{-5}$ Ω/□ to $1\times10^5$ Ω/□.

3. The charging device as claimed in claim 1, wherein said contact member is a sheet-like member.

4. The charging device as claimed in claim 3, further comprising:

a support member which supports said contact member in a cantilever manner.

5. The charging device as claimed in claim 3, wherein the bending moment of said sheet-like member is 20 g.cm or less.

6. The charging device as claimed in claim 5, wherein the bending moment of said sheet-like member is 10 g.cm or less.

7. The charging device as claimed in claim 1, wherein said contact member has a insulating portion electrically insulated, and wherein said contributing portion is located between said contact portion and said insulating portion.

8. The charging device as claimed in claim 1, wherein said contact member is made of metal.

9. The charging device as claimed in claim 8, wherein said contact member is made of stainless steel.

10. The charging device as claimed in claim 1, wherein said contact member is made of an organic material in which conductive carbon particles are dispersed.

11. The charging device as claimed in claim 10, wherein said organic material is polyimide resin.

12. A charging device for charging a charge receiving member comprising:

an electrical power source for supplying an electrical power consisting of a direct current component; and a contact member which is electrically connected with said electrical power source, said contact member having a surface including a contact portion and a contributing portion, said contact portion being for contacting with the charge receiving member, said contributing portion being for facing to the charge receiving member and being in a vicinity of said contact portion, said contributing portion contributing to charge the charge receiving member;

wherein said contributing portion has a surface resistivity of $1\times10^5$ Ω/□ or less, and the difference potential between said electrical power applied by said electrical power source and a surface potential of the charge receiving member before charged by said charging device is in a range from 550 v to 750 v.

13. The charging device as claimed in claim 12, wherein the surface resistivity of said contributing portion is in a range from $1\times10^{-5}$ Ω/□ to $1\times10^5$ Ω/□.

14. The charging device as claimed in claim 12, wherein said contact member is a sheet-like member.

15. The charging device as claimed in claim 14, further comprising:

a support member which supports said contact member in a cantilever manner.

16. The charging device as claimed in claim 14, wherein the bending moment of said sheet-like member is 20 g.cm or less.

17. THe charging device as claimed in claim 16, wherein the bending moment of said sheet-like member is 10 g.cm or less.

18. The charging device as claimed in claim 12, wherein said contact member is made of metal.

19. The charging device as claimed in claim 18, wherein said contact member is made of stainless steel.

20. The charging device as claimed in claim 12, wherein said contact member is made of an organic material in which conductive carbon particles are dispersed.

21. The charging device as claimed in claim 20, wherein said organic material is polyimide resin.

22. A method for charging a charge receiving member comprising the steps of:

providing a conductive member which has a surface including a contact portion and a contributing portion, said contributing portion having a surface resistivity of $1\times10^5$ Ω/□ or less;

contacting said contact portion of said conductive member with the charge receiving member, and facing said contributing portion of said member to the charge receiving member so that the maximum distance between said contributing portion and the charge receiving member is in a range from 5 μm to 60 μm; and applying an electrical power consisting of a direct current component to said conductive member to charge said charge receiving member through said contributing portion.

23. The method as claimed in claim 22, wherein said conductive member is a sheet-like member.

24. The method as claimed in claim 23, wherein said contacting and facing step is executed by supporting said conductive member in a cantilever manner.

25. The method as claimed in claim 22, further comprising the step of:

providing an insulative member on a portion of said surface of said conductive member to define said contributing portion between said contact portion and said portion on which said insulative member being provided.

26. A method for charging a charge receiving member comprising the steps of:

providing a conductive member which has a surface including a contact portion to be in contact with said charge receiving member and a contributing portion, said contributing portion having a surface resistivity of $1\times10^5$ Ω/□ or less;

setting said conductive member so that said contact portion is in contact with the charge receiving member and so that said contributing portion faces the charge receiving member; and applying an electrical power consisting of a direct current component to said conductive member to charge said charge receiving member through said contributing portion, the difference potential between said electrical power and a surface potential of the charge receiving member before charged by the application of said electrical power is in a range from 550 v to 750 v.

27. The method as claimed in claim 26, wherein said conductive member is a sheet-like member.

28. The method as claimed in claim 27, wherein said setting step is executed by supporting said conductive member in a cantilever manner.

29. The method as claimed in claim 26, further comprising the step of:

providing an insulative member on a portion of said surface of said conductive member to define said contributing portion between said contact portion and said portion on which said insulative member being provided.

* * * * *